United States Patent [19]

Berfield et al.

[11] Patent Number: 4,508,550

[45] Date of Patent: Apr. 2, 1985

[54] AIR FLOW RESPONSIVE OUTLET FROM TANK OF VACUUM CLEANER

[75] Inventors: Robert C. Berfield, Jersey Shore; Robert L. Crevling, Jr., Williamsport; Lonnie B. Lawson, Jr., Linden, all of Pa.

[73] Assignee: Shop-Vac Corporation, Williamsport, Pa.

[21] Appl. No.: 489,369

[22] Filed: Apr. 28, 1983

[51] Int. Cl.[3] ..... B01D 46/00

[52] U.S. Cl. ..... 55/216; 15/353; 55/219; 137/202

[58] Field of Search ..... 15/353; 137/202; 251/364; 55/165, 216, 219, 467; 92/34; 417/211.5

[56] References Cited

U.S. PATENT DOCUMENTS

| | | | |
|---|---|---|---|
| 1,498,399 | 6/1924 | Parker | 137/202 |
| 3,413,990 | 12/1968 | Gachot | 92/34 |
| 3,699,624 | 10/1972 | De Gain | 92/34 |
| 3,909,219 | 9/1975 | Fromknecht | 55/216 |
| 4,185,974 | 1/1980 | Hiester | 55/216 |

FOREIGN PATENT DOCUMENTS

| | | | |
|---|---|---|---|
| 1811234 | 7/1970 | Fed. Rep. of Germany | 92/34 |
| 1275350 | 5/1972 | United Kingdom | 137/202 |
| 0197709 | 9/1977 | U.S.S.R. | 137/202 |

*Primary Examiner*—Charles Hart

*Attorney, Agent, or Firm*—Ostrolenk, Faber, Gerb & Soffen

[57] ABSTRACT

An electric vacuum cleaner includes a tank for collecting suctioned liquid and particulate materials, an inlet to the tank, an air exit from the tank and a blower motor for drawing air out the air exit. The filter supporting cage surrounding the air exit has a floatable ball unit which is floated up to seal the air exit as the level of liquid in the collecting tank rises. The invention is designed to make the level of maximum fill of liquid in the collecting tank uniform, whether the vacuum cleaner is suctioning mixed liquid and air, which causes higher amounts of air through the air exit, or is suctioning liquid alone, which causes reduced amounts of air at the air exit, at the time that the floatable ball is floating up toward the air exit. An expansible bellows is positioned around the air exit and it collapses upwardly away from the floatable ball beneath it upon high air flow or velocity passing through the air exit and expands downwardly toward the floatable ball upon reduced air flow or velocity through the air exit.

14 Claims, 2 Drawing Figures

10
12
14
16
20
22
24
26
32
34
40
42
44
46
48
50
52
60
62
64
66
68
69
70
74
76
80
82
83
84
86

AIR FLOW RESPONSIVE OUTLET FROM TANK OF VACUUM CLEANER

BACKGROUND OF THE INVENTION

The present inventon relates to electric vacuum cleaners capable of suctioning both dry particulate materials and liquids and particularly to means at the exit from the collecting tank of a vacuum cleaner for halting suction at the same level of fill of the tank regardless of whether a mixture of liquid and air or merely liquid is being suctioned.

An electric vacuum cleaner broadly includes suction means, for generating suction force, a suction inlet through which material is to be suctioned and a collecting means or tank disposed between the suction inlet and the suction means. Without limitation to one type of vacuum cleaner, the present invention is shown in a tank or cannister type electric vacuum cleaner, where the collecting means is a large tank or drum, the suction inlet to the tank is through a port in the side of the tank or at the top of the tank and the suction means is supported at the lid of the tank and communicates into the tank for suctioning air out of the tank and thereby for generating suction force at the suction inlet. A hose with an intake nozzle remote from the suction inlet port is received in that port. The suction means is a blower motor, having its inlet communicating into the tank for generating a vacuum in the tank and having its outlet communicating externally of the tank and of the motor. The blower motor may be a bypass type motor, which has a separate cooling air circuit for cooling the motor. The entire cooling air circuit is external of the tank and is not pertinent here.

Filter means are disposed before the exit from the tank to the blower motor to retain collected particulate materials in the tank while permitting exit of air that has been pulled through the tank.

It is desirable to halt intake through the suction inlet when the tank becomes filled. This is a safety measure. When the tank becomes filled with particulate materials, which cannot pass the filter and which thus block the filter, the passage of air to the blower motor will be inhibited and suction will be halted. The invention is not directed to solving a problem experienced with dry material pickup.

Where the vacuum cleaner also is intended for suctioning liquid into the tank, because the liquid can permeate through the filter when the tank is eventually filled with collected liquid up to the filter, the liquid will pass the filter and will be suctioned through the tank outlet and through the section motor, undesirably expelling the collected liquid and possibly damaging the motor. Therefore, means are required to shut off suction by the blower motor when the tank becomes filled with liquid. To this end, it is conventional to provide a filter supporting cage extending down into the tank and surrounding the exit from the tank. A replaceable filter is installed on and supported by the cage.

Inside the filter cage is an element, such as a ball, which normally rests on the bottom of the cage, spaced away from the exit from the tank. The element is adapted to float on liquid, and when liquid fills the tank up to the filter cage and then passes through the filter into the cage, the floatable element or ball is floated up toward the tank exit. As the element approaches the exit, the suction force at the exit eventually draws the element which has floated up to it securely against the exit to thereafter block further air flow through the tank exit.

The filter cage serves as a guide for the floatable element to keep it beneath the air exit and guides it to float up to that exit. The filter cage and the floatable shut-off element in the cage are both shaped and positioned so that the element is spaced far enough away from the tank exit that the element must travel a considerable distance to shut off flow at the tank exit. This assures that the element does not prematurely pop up and close off the exit.

The vacuum cleaner takes in liquid in two different ways, either mixed with air in an air stream or as a stream of liquid not mixed with air. The intake of mixed air and liquid occurs when a surface having a small spill of liquid on it is being suctioned. In this case, the air flow through the tank exit is quite rapid. The intake of liquid alone occurs when liquid is being suctioned from a deep pool or supply, as from a sink, tub or tank, and where the inlet end of the suction hose is entirely submerged, so no air is sucked into the tank along with the liquid. In this case, there is very small air flow through the tank exit.

The different rates at which air exits from the tank will cause the floatable element or ball to seal the tank exit at different levels of fill of the tank. When the liquid in the tank has risen sufficiently to float the floatable element up through the filter cage, while the vacuum cleaner is suctioning mixed air and liquid so that the amount of air flow is higher, the floatable element is lifted off the rising pool of liquid in the filter cage and is sucked against the tank exit by the rapid air flow and pressure differential after the ball has been floated up to a first height. When the vacuum cleaner is suctioning liquid alone while the floatable element is floating up through the filter cage on the rising pool of liquid, because the air flow velocity through the tank exit is greatly reduced and there is little or no pressure differential, the floatable element is not lifted off the pool of liquid and sucked against the tank exit until the pool of liquid has risen to a second height, higher than the aforementioned first height. Thus, where mixed liquid and air is being suctioned, suction is terminated at an earlier time, with the tank less full, than when liquid alone is being suctioned, without air. Clearly, the maximum level of filling of the tank is dependent not merely upon the capacity of the tank, but upon the form in which the liquid is being suctioned into the tank at the time that the floatable element is floating up toward the tank exit on the rising pool of collected liquid. The difference between the first height of fill of the tank and the second height of the fill of the tank is about 2 inches or 5 cm.

SUMMARY OF THE INVENTION

Accordingly, it is the primary object of the invention to cause the floatable element or ball in the filter cage to close off the exit from the tank to the blower motor when the tank has the same level of fill of liquid, whether the vacuum cleaner is suctioning liquid along without air or is suctioning mixed air and liquid at the time that the floatable element is rising to close off the exit.

In all significant respects, except for the invention, the vacuum cleaner remains as discussed above. The filter cage is serving as the guide for the floatable element. The distinctive feature of the invention is that the position of the entrance port into the air exit from the tank is movable along the height of the filter cage dependent upon whether air or mixed liquid and air are being suctioned, on the one hand, or whether liquid alone is being suctioned, on the other hand. Where air is being suctioned, the entrance port into the air exit from the tank shifts upwardly in the tank and the filter cage, away from the floatable element. The floatable element must rise further on the pool of liquid in the tank before the flow of air exiting from the tank lifts the floatable element up to seal the tank exit. Where liquid alone is being suctioned, the entrance port into the air exit from the tank shifts downwardly in the tank and in the filter cage, toward the floatable element. The floatable element must float up on the liquid a shorter distance before it is suctioned against the exit from the tank to seal the exit. As a result of the variability in the position of the entrance port into the air exit from the tank, the tank will be filled with liquid to the same extent before air flow through the tank exit is shut off whether, at the time that suction is cut off, a mixture of air and liquid is being suctioned into the tank or only liquid is being suctioned.

Broadly stated, the exit from the tank is supported on means which is responsive to the rate at which suctioned air is flowing out the tank exit. Where the air flow rate out the tank exit is greater, as when mixed air and liquid is being suctioned, the exit from the tank is moved up in the filter cage, and where the rate of air flow out the tank exit is reduced, as when liquid alone is being suctioned, the exit from the tank is moved down in the filter cage.

In one preferred embodiment of the invention, the means which is responsive to the rate at which suctioned air is flowing out the tank exit comprises a flexible, pressure responsive, compressible and expansible bellows. The upper end of the bellows is held stationary at the exit opening in the tank lid, while the lower end of the bellows defines the entrance port of the tank exit and surrounds an opening in which the floatable element or ball is received for sealing off the tank exit. Depending upon the rate at which air flows through the bellows from the extrance port of the tank exit which faces down in the filter cage, the pressure drop along the bellows changes. A higher rate of air flow through the tank exit causes the bellows to collapse, whereby the entrance port of the tank exit moves up away from the bottom of the filter cage and further from the floatable element or ball, while a slower rate of air flow permits the bellows to expand to its extended condition, so that the entrance port of the tank exit is closer to the bottom of the filter cage and to the floatable element.

Other objects and features of the invention will become apparent from the following description of a preferred embodiment of the invention taken in conjunction with the accompanying drawings.

DESCRIPTION OF A PREFERRED EMBODIMENT

Figures 1, 2:
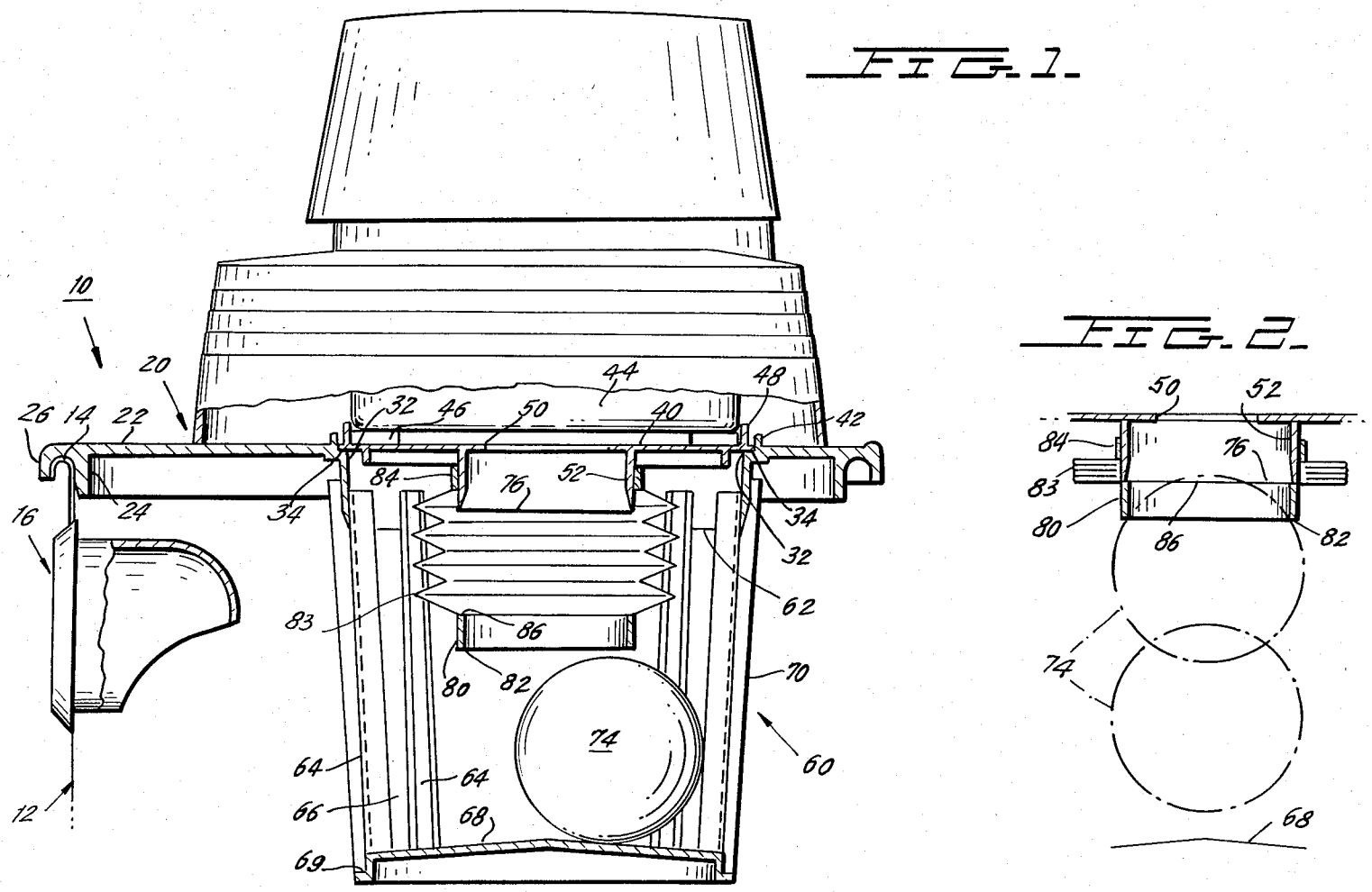
FIG. 1 is a side elevational view, partially in cross-section, of an electric vacuum cleaner in the vicinity of its lid and filter cage, and showing the invention in a first condition.
FIG. 2 is a fragmentary view of the invention shown in FIG. 1 with the invention shown in a second condition.

The present invention is now described in conjunction with a cannister or tank type electric vacuum cleaner which is used for collecting various types of materials, dry and wet particulate materials and water and other liquids. The outlet from the collecting tank is through a filter and the filter is supported on a filter cage. An example of one such electric vacuum cleaner is shown in U.S. Pat. No. 4,185,974, although the basic construction of a cannister or tank type vacuum cleaner is quite well known to persons skilled in the art, without examples being needed.

The cannister type electric vacuum cleaner 10 includes a conventional cylindrical metal tank 12 which is closed at its bottom (not shown). The upper peripheral edge 14 of the tank is folded over to form an annular engageable bead or rib. An inlet fitting 16 to the tank is illustrated as being disposed in the side wall of the tank. The invention may be used with any cannister type vacuum cleaner, including one where the inlet to the tank is through the lid. The inlet fitting 16 receives a hose, or the like, not shown, to which an intake nozzle is connected. Materials to be collected in the tank are suctioned through the hose, pass through the inlet fitting 16 and fall into the tank.

Seated at the top of the tank 12 and secured at the upper peripheral edge 14 thereof is the lid and filter cage assembly 20, which may be of any conventional design, or may be of the design shown in aforesaid U.S. Pat. No. 4,185,974. The lid of the assembly 20 comprises a solid circular disc 22 with an outer diameter slightly greater than the external diameter of the tank 12. The lid 22 is emplaced over the upper edge 14 of the tank. The upper edge 14 is bracketed by the annular internal sealing flange 24 and the annular external sealing flange 26, and the placement of these flanges is selected to cooperate with the tank edge 14 to securely squeeze tightly over the edge 14. Clamping buckles, or the like (not shown), removably hold the lid securely to the tank.

The lid has circular opening 32 defined in it. Radially immediately outward of that opening is the narrow supporting shelf 34. The lid includes motor support 40 which is a disc having a diameter slightly greater than that of the opening 32. The support 40 rests on the annular shelf 34 and is held in position there by the upstanding annular flange 42 on the lid. The support 40 carries the conventional electric vacuum cleaner blower motor 44 on it. The annular gasket 46 between the motor 44 and the support 40 damps vibration and seals the motor inlet. The upstanding annular flange 48 on the support 40 positions the gasket 46 and the housing of the motor 44.

There is an opening 50 through the support 40. Through the opening 50, the inlet to the motor 44 communicates through the lid and into the tank 12. The opening 50 is the exit from the tank. The gasket 46 seals the motor inlet so that inlet to the blower motor 44, therefore, is from the tank. There is an annular flange 52 disposed on the underside of the support 40 and radially outside the opening 50, which serves as a support for the bellows 83 of the invention, to be described below.

The vacuum cleaner is intended to draw in particulate materials along with the air that is suctioned through the inlet fitting 16. Such particulate materials are to be collected in the tank 12 and must not be permitted to exit through the exit opening 50. To this end, filter means 60 is provided. The means 60 defines an enclosure for the floatable ball 74 and guides it to float toward the opening 50, as described below. Beneath the lid 22 at the opening 32, there is an annular depending flange 62 which may be integrated with the lid 22, whereby the illustrated lid 22 and filter cage 62–68 are an integral construction. Of course, a conventional filter cage, which is separate from the lid to which it is affixed may be used with this invention. Supported beneath the annular flange 62 are a circumferential array of vanes 64, which are widely spaced apart as at 66 to define a filter supporting cage with clear passageways between the vanes 64 for air to leave the tank 12. At the bottom of the vanes 64 is the closed off floor 68. The elements 62–68 together define a filter cage.

An annular drum-type or cannister filter unit 70 is slipped over the filter cage, is supported internally by the exteriors of the vanes 64, seals with the flange 62 above and rests on the periphery 69 of the floor 68 below, closing off the open areas of the filter cage and providing a filter between the interior of the tank and the outlet opening 50 through the lid. While the filter 70 is capable of trapping particulate materials, it cannot block the passage of liquid through itself, whereby as the level of liquid in the tank 12 rises above the floor of the filter cage, the level of liquid in the filter cage rises as well, and this lifts the ball 74.

The filter cage has a number of characteristics which were selected because of the intended purpose of this type of vacuum cleaner, which is to collect either liquid or particulate materials. Dry materials would simply fill the tank, and the precise configuration of the filter or the support for the filter would not be that important. It is because the tank collects liquid that the filter cage and the filter it supports are configured as illustrated. As liquid collects in the tank, the level of liquid rises. The filter cage projects down from the lid into the tank. When the tank becomes filled with liquid, and were the level of liquid to rise to, or quite near to, the lid opening 50, liquid which permeates through the filter and into the cage might be suctioned out of the tank through the motor, which is undesirable. Therefore, the exit of liquid should be stopped before it reaches to the opening 50.

For preventing the passage of liquid through the lid opening 50, a floatable element in the form of a ball 74 is disposed beneath the tank exit, and when the liquid rises sufficiently in the tank and in the filter cage, it floats the ball up toward the tank exit. Eventually, the ball floats near enough to the tank exit and the air flow through the exit sucks the ball into the exit and closes off the exit against further flow of air and liquid. The filter cage is shaped to position the ball beneath the exit and to guide the ball to float up to the exit. The interior edges of the vanes 64 prevent the ball from moving sideways and the bottom 68 of the cage holds the ball beneath the exit.

Were the air flow responsive means of the invention absent, and were the exit 50 simply surrounded by the annular depending flange 52, the ball 74 would simply float up to the bottom edge 76 of the depending flange 52 and seal off the exit 50. However, because the vacuum cleaner may be used either to suction a mixture of liquid and air, which would fill the tank with liquid, or to suction liquid alone, which would also fill the tank with liquid, the ball 74 would seal against the bottom edge 76 of the flange 52 at different liquid fill levels of the tank, dependent upon whether the vacuum cleaner was then suctioning mixed liquid and air or liquid alone. As noted above, when the vacuum cleaner is suctioning mixed liquid and air through the inlet hose to the fitting 16, the amount of air flow through the exit 50 and thus through the flange 52 will be relatively greater and more rapid. On the other hand, when the inlet hose to the fitting 16 is submerged in liquid, and no air is being suctioned along with the liquid, the amount of the air flow through the flange 52 and the exit 50 will be considerably less and slower. As the ball 74 floats up near the bottom edge 76 of the flange 52, the air flowing past it will suck the ball up to the bottom edge 76 of the flange and the velocity of the air flow will determine how close the ball 74 must be to the bottom edge 76 of the flange 52 before the ball is sucked up to it. Because of the different air flow rates when mixed air and liquid is being suctioned or liquid alone is being suctioned, the floating ball 74 will be pulled off the rising liquid and seal against the bottom edge 76 of the sleeve 52 at an earlier point, that is when the tank is less filled, when mixed liquid and air are being suctioned than when liquid along is being suctioned. The invention is designed to avoid this differential, so that the floatable ball will seal off the outlet from the tank at the same level of fill of the tank, whether the vacuum cleaner is suctioning liquid alone or mixed liquid and air at the time that the ball is being floated up near the outlet from the tank.

According to the invention, the entrance point to the air exit from the tank is not fixedly located at the bottom edge 76 of the flange 52. Instead, that entrance point is at the bottom edge 82 of the annular sleeve 80. The bottom edge 82 thereby serves as the entrance port for the air exit from the tank. The height of that sleeve bottom edge 82 above the floor 68 of the filter cage is automatically variable dependent upon the velocity of the air passing through the sleeve 80 and the tank exit 50, which velocity, in turn, is dependent upon whether the vacuum cleaner is suctioning mixed liquid and air or liquid alone. The sleeve 80 is attached at the lower end of a flexible, accordion-like, open ended, compressible and expansible hollow bellows 83. The bellows has normal natural bias toward its expanded condition of FIG. 1. The upper end of the bellows 83 is fixed to a collar 84 which is secured to the exterior of the flange 52 and the collar 84 is spaced slightly up from the bottom edge 76 of the flange 52. The bellows 83 is sufficiently flexible that it responds to the variations in the velocity and rate of air flow passing through the sleeve 80, bellows 83 and flange 52, dependent upon whether the vacuum cleaner is suctioning air or liquid in air, on the one hand, or liquid only, on the other hand. When the vacuum cleaner is suctioning liquid only, and there is reduced amount of air flow and velocity, the belllows 83 is normally biased into its expanded condition shown in FIG. 1, and the bottom edge 82 of the sleeve 80 is closer to the ball 74. Eventually, the ball 74 is floated up quite near to the bottom edge 82 of the sleeve 80 and the reduced amount of air flow and air velocity through the sleeve 80 finally draws the ball 74 to seal against the bottom edge 82 only when the ball 74 has been floated close to the bottom edge 82.

With reference to FIG. 2, when the vacuum cleaner is suctioning a mixture of liquid and air (and even when it is suctioning mixed particulate materials and air or air alone), the bellows 83 is collapsed by the air rushing through the sleeve 80, through the bellows 83 and through the flange 52, due to the increased pressure drop across the bellows. The bellows collapses far enough that the top edge 86 of the sleeve 80 abuts the lower edge 76 of the flange 52, clearly raising the entrance port at the bottom edge 82 of the sleeve 80 away from the ball 74. The ball 74 is floated up toward the bottom edge 82 of the sleeve 80. When the tank has a particular level of fill of liquid and with the bellows 83 in the collapsed condition of FIG. 2, it would require a greater suction force at the sleeve 80 to lift the floating ball 74 off the liquid to sealingly engage the sleeve 80 at its bottom end 82. With the tank at the same level of fill and with the bellows in the condition of FIG. 1, it would require a smaller suction force at the sleeve 80 to lift the floating ball off the liquid to sealingly engage the bottom edge 82 of the sleeve. Because the bottom end 82 of the sleeve 80 is at different elevations at different air flow velocities through the sleeve, the liquid level at which the ball 74 is drawn againt the bottom edge 82 of the sleeve 80 to close off the exit 50 from the tank is the same when the bellows 83 is in either of the conditions of FIGS. 1 and 2. The heights of the flange 52 and the sleeve 80, the diameter of the ball 74 and the height of the floor 68 of the filter cage are all related for this purpose.

The blower motor 44 is a conventional blower motor and is thus not shown or described in detail. It has an inlet which faces down to communicate with the exit 50 from the tank and has an outlet from the housing above the lid. A fan in the motor draws air through the tank inlet 16 and blows air out the motor outlet. This conventional blower motor is known to one skilled in the art and thus is not shown in detail.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A vacuum cleaner with an air flow responsive air exit, comprising:

a collecting tank for collecting suctioned material; an inlet to the tank for air, liquid and particulate material; an air exit from the tank; suction means communicating with the air exit for drawing air out of the tank through the air exit and for thereby creating suction at the air inlet;

a floatable element capable of floating on liquid, and a guide supporting the floatable element beneath the air exit for guiding and enabling the element to float up toward the air exit as the level of liquid in the tank rises and the liquid floats the element up toward the air exit;

means attached to the air exit including means selectively movable downwardly into the tank and toward the floatable element and upwardly in the tank and away from the floatable element; that means including the entrance port into the air exit; that means being movable responsive to the velocity and amount of air flow through the air exit caused by the suction means, such that the means moves downwardly on reduced air velocity or reduced air flow and upwardly on increased air velocity or increased air flow.

2. The vacuum cleaner of claim 1, wherein the means comprises compressible and expansible bellows having an air extrance therein facing toward the floatable element and the air entrance being the entrance port into the air exit; the bellows being compressed to a shorter length by more rapid or greater air flow into the air entrance of the bellows and being expanded to greater length by relatively slower or less air flow into the air entrance of the bellows.

3. The vacuum cleaner of claim 1, wherein the suction means comprises a blower motor having an inlet communicating with the tank exit and having an outlet leading to the outside of the vacuum cleaner.

4. The vacuum cleaner of claim 1, further comprising a filter for blocking the air exit and for filtering out particulate materials from passing to the air exit.

5. The vacuum cleaner of claim 4, wherein the filter surrounds an enclosure, and the air exit is an outlet from the enclosure; the floatable element being inside the enclosure, and the enclosure serving as the guide supporting the floatable element.

6. The vacuum cleaner of claim 5, further comprising a filter cage for supporting the filter and for defining the enclosure on which the filter is supported.

7. The vacuum cleaner of claim 6, wherein the filter cage includes a closed floor spaced below the air exit and on which the floatable element rests; the cage having open sides which are surrounded by and closed off by the filter.

8. The vacuum cleaner of claim 1, wherein the tank has an open end; a lid closing over the open end off the tank; the air exit being in the lid, and the means being movable with respect to the lid.

9. The vacuum cleaner of claim 8, wherein the means comprises compressible and expansible bellows having an air entrance at one end facing toward the floatable element and the air entrance being the entrance port into the air exit; the bellows having an opposite end away from the air entrance thereof and the opposite end is supported at the lid, whereby the air entrance moves toward and away from the lid as the bellows is respectively compressed to a shorter length and expanded to a greater length; the bellows being compressible to shorter length between the ends thereof by more rapid or greater air flow into the air entrance of the bellows and being expanded to greater length between the ends of the bellows by relatively slower or less air flow into the air entrance of the bellows.

10. The vacuum cleaner of claim 9, wherein the bellows is normally biased to its expanded condition.

11. The vacuum cleaner of claim 10, further comprising a filter for blocking the air exit and for filtering out particulate materials from passing to the air exit; the filter surrounds an enclosure, and the air exit is an outlet from the enclosure; the floatable element being inside the enclosure, and the enclosure serving as the guide supporting the floatable element.

12. The vacuum cleaner of claim 11, further comprising a filter cage for supporting the filter and for defining the enclosure on which the filter is supported; the filter cage being supported beneath the lid.

13. The vacuum cleaner of claim 11, wherein the tank has a top side, at which the open end thereof is located, and the lid being over the open end at the top side of the tank; the tank having lateral sides, and the tank inlet being in a lateral side of the tank.

14. The vacuum cleaner of claim 13, wherein the suction means comprises a blower motor having an inlet communicating with the tank exit and having an outlet leading to the outside of the vacuum cleaner.

* * * * *